US011969079B2

(12) United States Patent
Geller et al.

(10) Patent No.: US 11,969,079 B2
(45) Date of Patent: Apr. 30, 2024

(54) HAIRBRUSH APPARATUS WITH DETACHABLE BRUSH HEADS

(71) Applicants: Jennifer Geller, New York, NY (US); Richard Geller, New York, NY (US)

(72) Inventors: Jennifer Geller, New York, NY (US); Richard Geller, New York, NY (US)

( * ) Notice: Subject to any disclaimer, the term of this patent is extended or adjusted under 35 U.S.C. 154(b) by 1098 days.

(21) Appl. No.: 15/906,492

(22) Filed: Feb. 27, 2018

(65) Prior Publication Data

US 2018/0242720 A1 Aug. 30, 2018

Related U.S. Application Data

(60) Provisional application No. 62/464,877, filed on Feb. 28, 2017.

(51) Int. Cl.

| | |
|---|---|
| ***A45D 6/00*** | (2006.01) |
| ***A46B 5/00*** | (2006.01) |
| ***A46B 7/04*** | (2006.01) |
| ***A46B 9/02*** | (2006.01) |
| ***A46B 15/00*** | (2006.01) |

(52) U.S. Cl.

CPC ..... *A46B 5/0095* (2013.01); *A46B 7/042* (2013.01); *A46B 9/023* (2013.01); *A46B 15/0026* (2013.01); *A46B 2200/104* (2013.01)

(58) Field of Classification Search

CPC ... A45D 2/00; A45D 2/02; A45D 2/08; A45D 2/10; A45D 2/145; A45D 2/148; A45D 2/2471; A45D 2/2464; A45D 2/2485; A45D 6/02; A45D 6/04; A46B 5/0095; A46B 7/042; A46B 9/023; A46B 2200/104

See application file for complete search history.

(56) References Cited

U.S. PATENT DOCUMENTS

| | | | | | |
|---|---|---|---|---|---|
| 3,413,984 | A * | 12/1968 | Tracy | A45D 6/04 | 132/238 |
| 5,513,665 | A * | 5/1996 | Chan | A45D 4/10 | 132/227 |
| 5,884,635 | A * | 3/1999 | O'Brien | A45D 2/362 | 132/227 |
| 5,975,091 | A * | 11/1999 | Balanchi | A45D 6/04 | 132/237 |
| 6,070,597 | A | 6/2000 | Motherhead | | |
| 6,502,585 | B1 * | 1/2003 | Mazzei | A46B 7/04 | 132/237 |

(Continued)

*Primary Examiner* — Rachel R Steitz

(74) *Attorney, Agent, or Firm* — Volpe Koenig

(57) ABSTRACT

A detachable hair brush apparatus is disclosed. The hair brush apparatus may comprise a handle with elongated metal extension rods at one end and at least one hollow brush head for insertion around the metal extension rods. In a locked position, the metal extension rods extend substantially through a base of the brush head. At least one button may be located on said handle for releasing the mechanical locking engagement. Torque provided by a user of the hair brush apparatus is absorbed by the metal extension rods of the hair brush handle. In this way, functional separation of two distinct systems is provided for, namely the function of "attaching" and the function of "absorbing torque". This will make for increased robustness of each system. In a preferred embodiment, neither the handle nor the at least one hollow brush head comprises a magnet for coupling.

19 Claims, 6 Drawing Sheets

(56) References Cited

U.S. PATENT DOCUMENTS

| | | | | |
|---|---|---|---|---|
| 7,198,048 | B2 * | 4/2007 | Johnson | A46B 7/04 132/148 |
| 7,296,580 | B1 | 11/2007 | Sbardella | |
| 2008/0105274 | A1 * | 5/2008 | Kennedy | A45D 2/122 132/210 |
| 2008/0202545 | A1 | 8/2008 | Purvis et al. | |
| 2009/0229624 | A1 | 9/2009 | Purvis et al. | |
| 2011/0114111 | A1 | 5/2011 | Guthans | |
| 2018/0192756 | A1 * | 7/2018 | Bennett | A45D 1/04 |

* cited by examiner

HAIRBRUSH APPARATUS WITH DETACHABLE BRUSH HEADS

CROSS REFERENCE TO RELATED APPLICATIONS

This application claims the benefit of U.S. Provisional Patent Application No. 62/464,877, filed on Feb. 28, 2017, the contents of which are incorporated by reference as if fully set forth herein.

TECHNICAL FIELD

The subject matter described herein relates to hair brushes with detachable brush heads for use on human hair.

SUMMARY

A professional stylist has an advantage of using several hair brushes simultaneously to dry hair. A blow out hair style may be achieved by rolling several hair brushes into hair while the hair is optimally damp in its entirety. When heat is applied over the whole of the head, by a blow dryer prior to the hair drying, hair may dry equally. This effect may be difficult to achieve by a user working on his or her own head of hair. Disclosed herein is an apparatus and method which allows a home user to quickly use a device to roll in and deploy assorted detachable brush heads in quick succession, while the hair wetness is optimal for styling. The disclosed device avoids the problem of traditional hair brushes falling out of the subject's hair. Additionally, use of the disclosed device allows a stylist or home user to avoid having to deal with multiple handles protruding and interrupting the blow drying process.

In one embodiment, a hair brush apparatus may comprise a handle with elongated metal extension rods at one end and at least one hollow brush head for insertion around the metal extension rods. In a locked position, the metal extension rods extend substantially through a base of the brush head. At least one button may be located on said handle for releasing the mechanical locking engagement. Torque provided by a user of the hair brush apparatus is absorbed by the metal extension rods of the hair brush handle. In this way, functional separation of two distinct systems is provided for, namely the function of "attaching" and the function of "absorbing torque". This will make for increased robustness of each system. In a preferred embodiment, neither the handle nor the at least one hollow brush head comprises a magnet for coupling.

BRIEF DESCRIPTION OF THE DRAWING(S)

DETAILED DESCRIPTION OF THE PREFERRED EMBODIMENT(S)

A detachable hair brush apparatus and method is disclosed for allowing home users to achieve similar results achieved in professional hair salons, thus replicating controlled smooth and styled hair achieved by professional stylists working with specialty brushes.

Detachable hair brush products exist in the market but these products are hampered with suboptimal mechanisms for properly setting and then deploying brush heads into a subjects head of hair. To wit, Guthans, US Patent Publication No. 20110114111, discloses a hair styling kit with a handle and a plurality of detachable brush heads. Each brush head is connectable to the handle using a magnetic connection. If this magnetic connection is weak, the brush head may be allowed to deploy prematurely. If too strong, the magnetic connection may impair seamless deployment. Additionally, a magnetic connection may add cost and/or weight to an otherwise inexpensive and lightweight brush.

Another attempt at providing a detachable brush head is disclosed by Motherhead, U.S. Pat. No. 6,070,597. Like Guthans, Motherhead contemplates a similar system using magnets and suffers from the same drawbacks, for example, inelegant coupling reliant upon magnetic attraction which may hamper smooth and easy single-handed disengagement of the brush head. Motherhead is different from Guthans in that Motherhead uses a key like connection means to transfer torque from the brush handle to the brush head without the two pieces disconnecting. The key connection comprises a key on the handle and a key hole on each brush head. Since the key must be oriented precisely in the same direction as the key hole, a user may be required to use two hands to orient the key and key hole.

Commercial attempts at providing detachable hair brush products include a product called CurlMe, manufactured by the Pro Blo Group, and a product called Click N Curl, manufactured by Casual Panache Inc. Both of these products suffer from a similar design restriction, whereby a considerable amount of torqueing necessary for styling is all concentrated at a point of coupling which, may impair consistent performance over time as weakening occurs at the coupling, and may also result in an unpredictable deployment of the brush head prematurely when a user applies the necessary torque to use the brush. Further, in the case of the Click N Curl, there is no locking mechanism which holds the brush to the handle. This may make it particularly difficult to employ the brush head without any unintended deployment.

Figure 1:
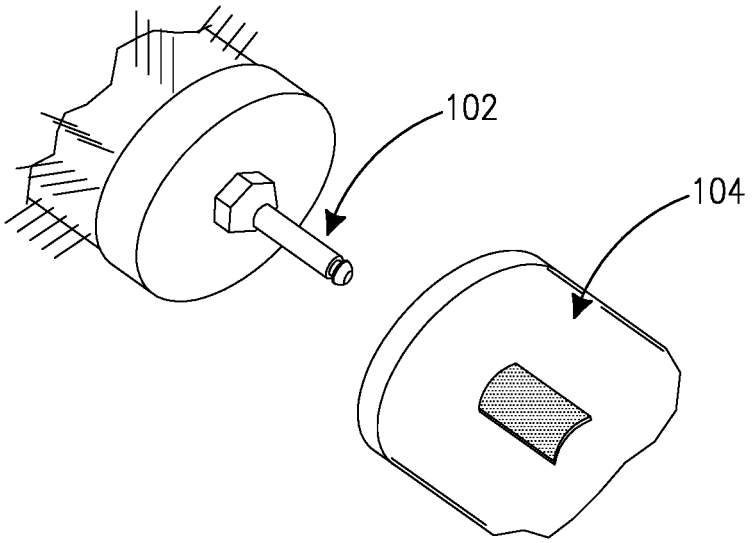
PRIOR ART FIG. 1
FIG. 1 illustrates a prior art hair brush connection mechanism.

FIG. 1 illustrates a prior art connection mechanism 100 where a rod 102 is located on an end of a detachable hair brush head. The rod may be inserted into a rod receiving bore on the brush handle 104. Because the length of rod 102 is small, when the handle and brush head are attached, significant play may occur between the handle and brush head. A similar deficiency exists with the mechanism of FIG. 2.

Figure 2:
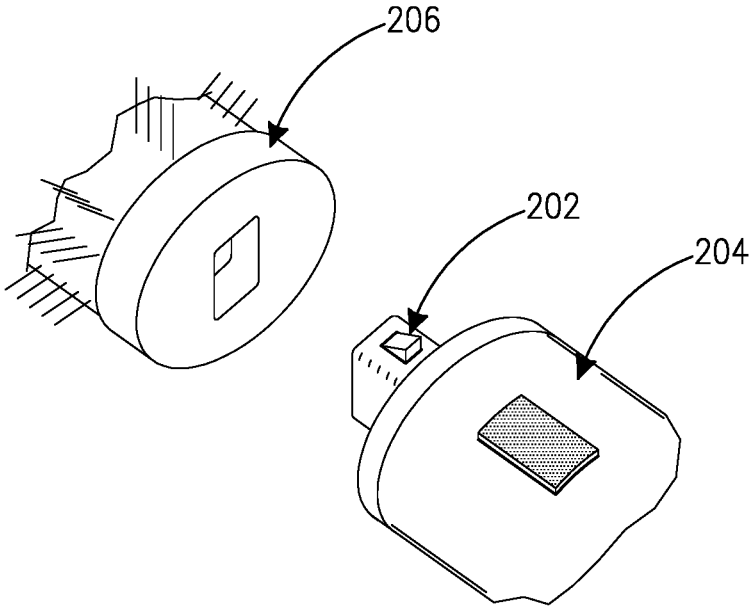
PRIOR ART FIG. 2
FIG. 2 illustrates a prior art square taper mating mechanism.

FIG. 2 illustrates a prior art square taper mating mechanism 200, in which a male square taper 202 resides on an end of a brush handle 204. Because the square taper does not extend substantially through the brush head, play may occur at the point of connection between brush handle 204 and brush head 206. Due to common wear of the plastic components which make up this mating mechanism, play becomes even more evident after continued use.

Figure 3:
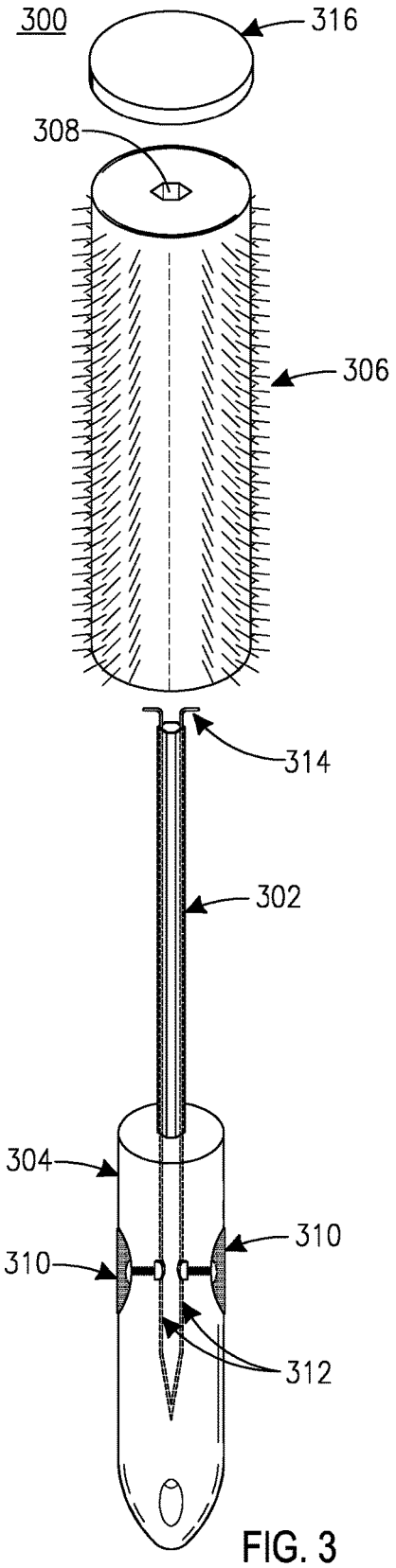
FIG. 3 illustrates an improved brush design.

FIG. 3 illustrates an improved brush design 300. With reference to the improved brush design 300, a spindle 302 is designed to extend from an end of brush handle 304 through the full length of a brush head 306. Each brush head may have a hollow channel 308 through which the spindle will slide. This ensures an equal distribution of torque along the entire axis and not purely at the mating point of the brush and handle. The spindle may be multi-sided in order to allow the transference of torque to the brush head with risk of any slippage of the brush head and/or inordinate strain which may otherwise cause weakness over time where the brush head and the handle meet. Preferable, the spindle will have 6 sides, but more or less may be used. As the transference of torque is uniformly distributed across the length of the spindle, there is lower risk of the detaching mechanism absorbing the brunt of the torque and wearing down over time. The spindle may be slightly tapered to allow for easy insertion and removal from each brush head. The spindle will be preferably made of plastic, but may also be made of metal, such as aluminum.

The detaching mechanism may employ two spring-loaded buttons 310 on opposing sides of the handle that when squeezed/pushed toward the center axis of the brush control two metallic rods 312 running the length of the spindle that together to form a "T" 314 at the top of the spindle. In one embodiment, each one half of the "T" 314 has a 90-degree bend at the top. When not depressed, "T" 314 holds the brush head to the spindle, preventing it from slipping off the top. When depressed, the rods come together inside the diameter of the spindle and brush head channel, moving the 90 degree "T" 314 toward the center of the axis and providing the necessary clearance for the spindle and handle to be withdrawn, slipping away from the brush head which remains snug in the hair. The "T" 314 at the top of spindle may be covered by an end cap 316 on each brush head 306. The benefits of end cap 316 may be twofold. First, the end cap 316 may prevent hair from becoming trapped between the "T" and the brush head. Second, end cap 316 allows a user to quickly determine which end of a brush head to insert the spindle, as the spindle and brush head may both be tapered and only fit in one direction. In a preferred embodiment, end cap 316 is fixed to brush head 306.

Figure 4:
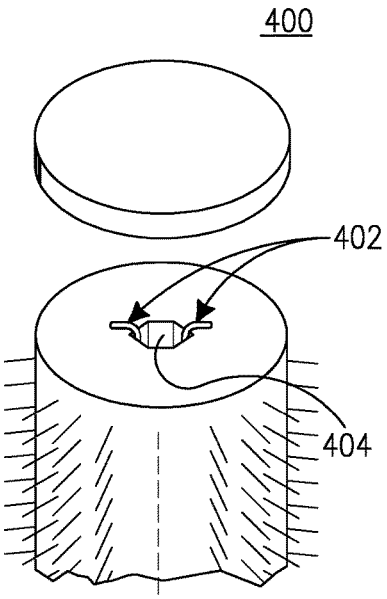
FIG. 4 illustrates elongated metallic rods in a locked position.

FIG. 4 illustrates the metallic rods in a locked position 400. When locked, or extended, rods 402 secure brush head. It should be noted that, in a preferred embodiment, end cap is rigidly affixed to each brush head. Channel 404 is preferably 6 sided and symmetrical. By being symmetrical, a user may insert spindle into channel 404 with minimal focus on determining placement and rods 402 may extend and lock in brush head regardless of orientation.

Figure 5:
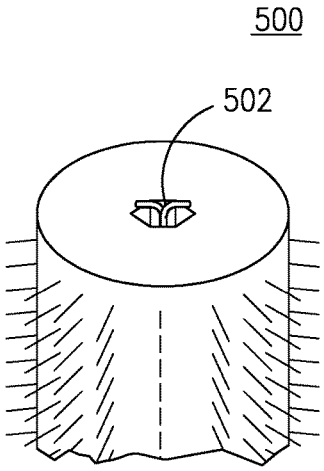
FIG. 5 illustrates elongated metallic rods in an unlocked position.

FIG. 5 illustrates the metallic rods in an unlocked position 500. When unlocked, or pressed together, the metallic rods 502 do not interfere with removal or attachment of a brush head.

Figure 6:
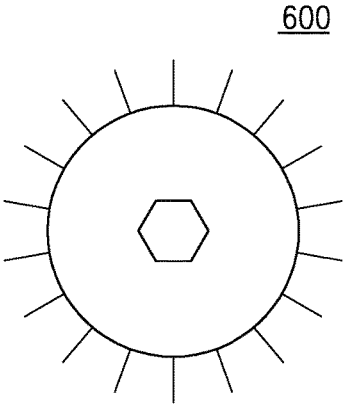
FIG. 6 illustrates a cross section of a preferred brush head.

FIG. 6 illustrates a cross section of a preferred brush head 600. Preferably, the insertion end of a brush head will have an opening slightly larger than an opening on the distal end. This tapered design allows for low force insertion by the spindle. Distal end preferably is covered by end cap. FIG. 6 illustrates 18 rows of bristles, but any number of bristles may be used and still be consistent with this disclosure.

Figure 7:
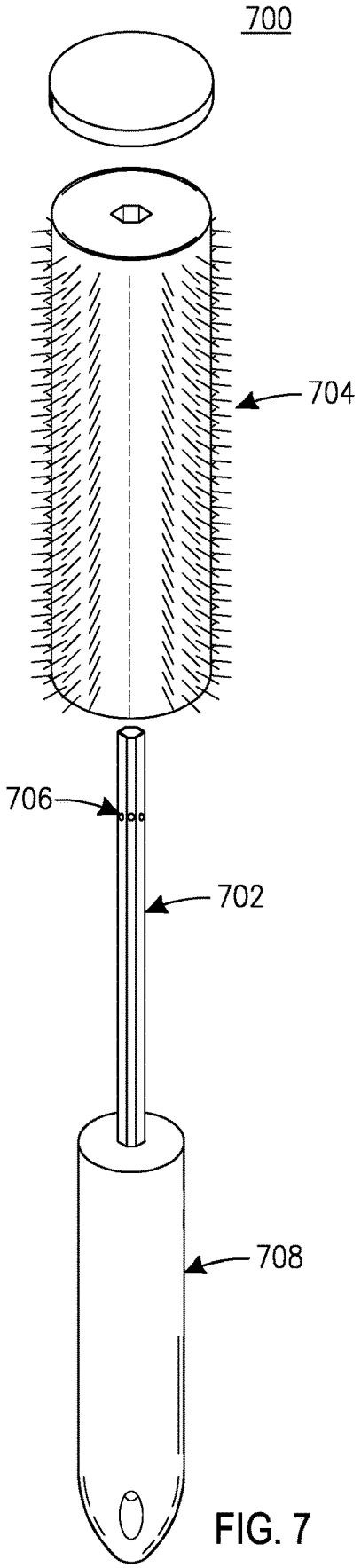
FIG. 7 illustrates a button less embodiment in which spindle may be affixed to brush head by ball bearings.

FIG. 7 illustrates a button less embodiment 700, wherein spindle may be affixed to brush head by ball bearings 706. When fully inserted into a brush head, ball bearings 706 on spindle 702 engage a groove on brush head 704. This embodiment allows for substantial torqueing of the brush, since spindle continues to extend substantially through brush head. Bearings 706 may be spring loaded and forced to extend beyond the outer surface of spindle 706. When inserted into brush head, bearings may be pushed inwards by the inner surface of the channel inside brush head 704. Bearings may lock in groove and may be removed via a user holding brush head 704 in the user's hair while forcibly pulling brush handle 708 away from brush head 704. Alternatively, a similar locking mechanism may be provided closer to, or further from, brush handle, so long as spindle 702 extends substantially through the length of brush head 704. Preferably bearings will be placed on all sides of spindle 706. Alternatively, bearings may be placed on less than all sides of spindle.

Figure 8:
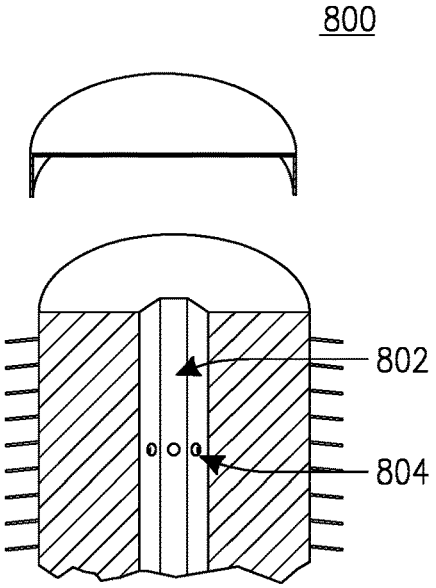
FIG. 8 illustrates a cross section of brush head.

FIG. 8 illustrates a cross section of brush head 800. Inside hollow channel 802 is one or more grooves 804 for mating with one or more bearings. Grooves 804 may be all on the same plane or may be staggered such that one or more bearings create a lock on more than one plane.

Figure 9:
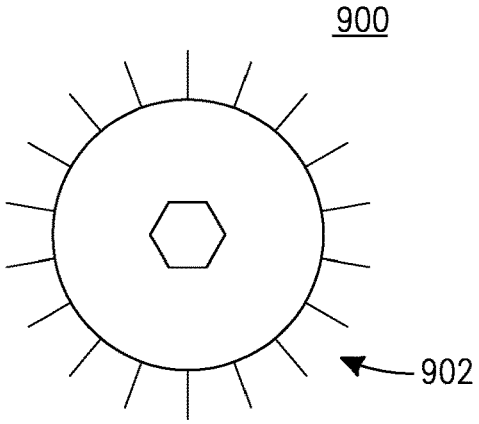
FIG. 9 is a cross section of brush head, similar to that of FIG. 6.

FIG. 9 is a cross section of brush head 900, similar to that of FIG. 6. From the cross section view, a groove for mating is not seen. In a preferred embodiment, the channel and spindle running through brush head are tapered.

Figure 10:
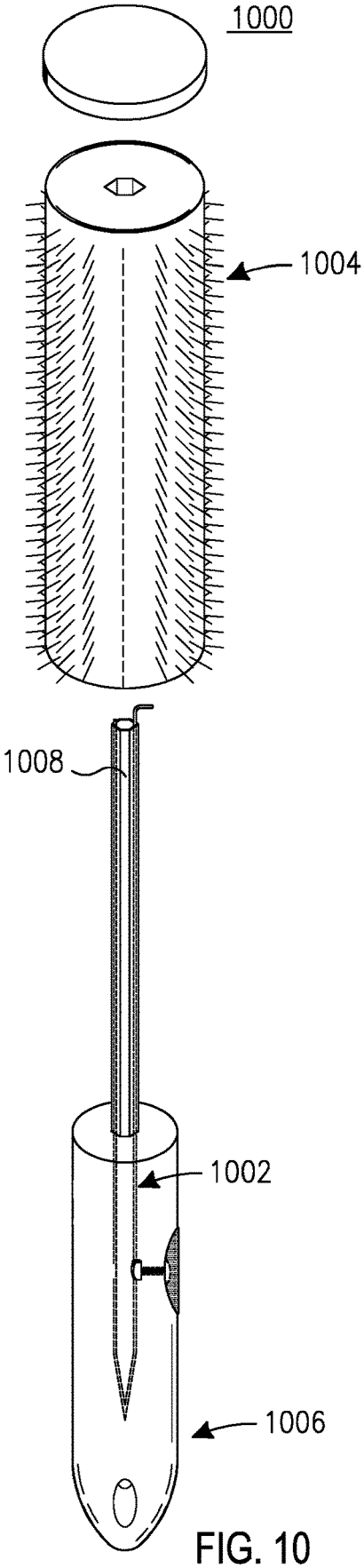
FIG. 10 illustrates a single button embodiment.

FIG. 10 illustrates a single button embodiment 1000. In this embodiment, only one 1002 of a plurality of metal rods engage, and lock, brush head 1004 to brush handle 1006. In another embodiment, button 1006 may be configured to press upon a single rod or another single mechanical connection member. As shown in FIG. 10, rod 1002 extends above the full length of spindle 1008, however this rod may extend only partially along spindle 1008. Rod 1002 may be preferably made of metal, but other materials may be used.

Figure 11:
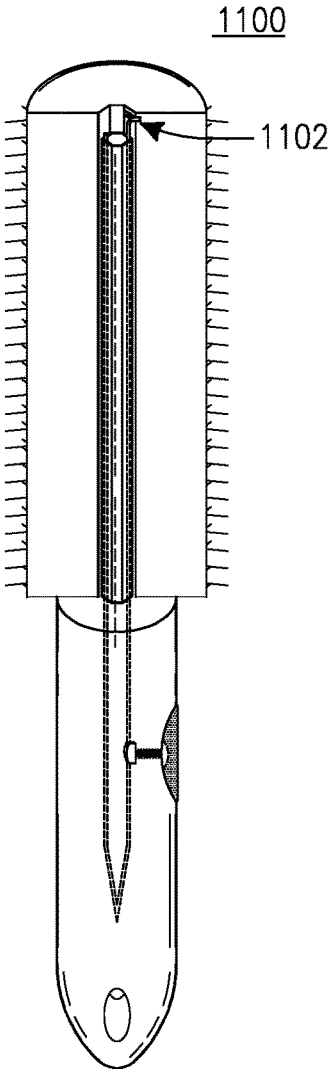
FIG. 11 illustrates brush handle and brush head in a locked state.

FIG. 11 illustrates brush handle and brush head in a locked state 1100. Rod 1102 may form an "L" shape instead of the "T" shape disclosed in FIGS. 3-5. The "L" may lock or spindle to brush head only on one side. In one embodiment, metal rod engages a groove inside brush head. In another embodiment, a portion of the "L" shape may rest on an end of brush head. In this embodiment, end cap may cover and enclose the "L".

Figure 12:
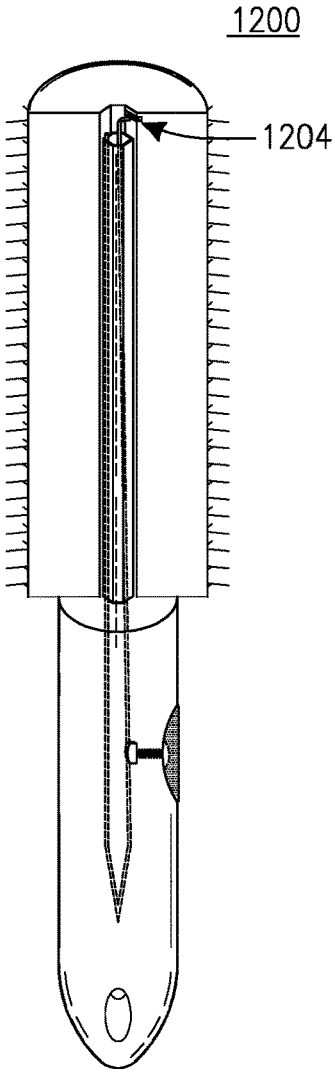
FIG. 12 illustrates brush handle and brush head in an unlocked state.

FIG. 12 illustrates brush handle and brush head in an unlocked state 1200. In this state, single button may be pressed, thus causing a portion of the "L" to not extend into a groove on brush head.

The features described herein may also be implemented, on any other appropriate type of consumer device or may be packaged as a part of or within another type of consumer device. Hair brush heads may be sold separately from hair brush handle and still be consistent with this disclosure. Preferably, hair brush heads will be sold in different sizes and arrangements. These different sizes and arrangements may be used on hair of different lengths and thicknesses, e.g. diameter. For example, a package of large diameter brush heads may be sold for use on long hair, while a package of smaller diameter rollers may be sold for use on shorter hair.

Figure 13:
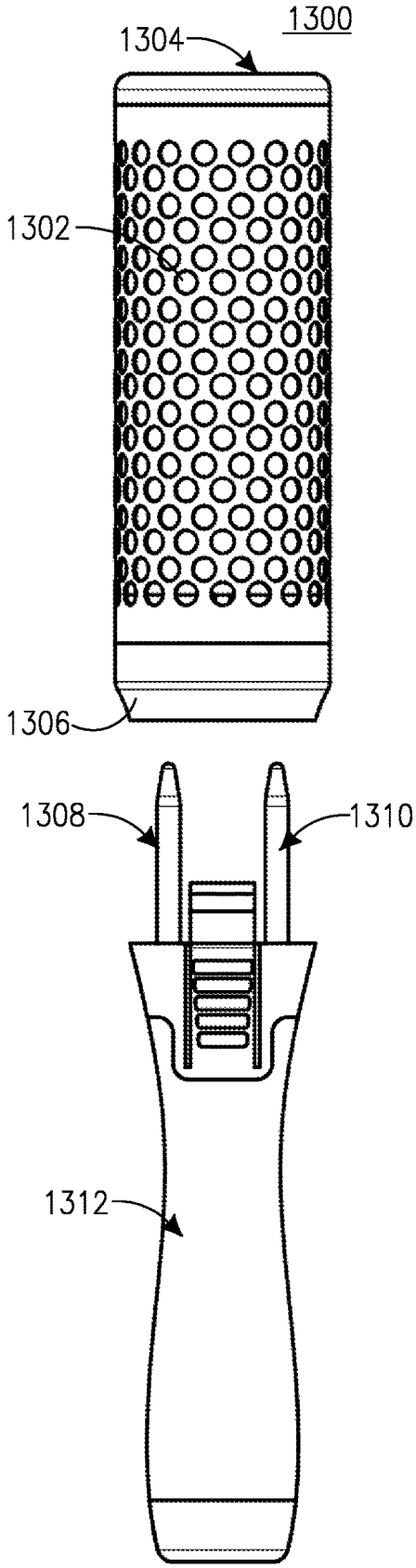
FIG. 13 illustrates a brush handle and brush head in a twin fork embodiment.

FIG. 13 illustrates a brush handle and brush head in a twin fork embodiment 1300. In FIG. 13, a brush head 1302 is shown above a brush handle 1312. The brush head is shown with through holes which may accommodate bristles of various sizes, shapes and diameters. Brush head 1302 is illustrated with an end cap 1304 and base 1306. Base 1306 may be adapted to accommodate metallic extension rods 1308-1310 of brush handle 1312 which may form a twin-fork joining system. A twin-fork type joining system may improve an ability to drive torque through along the metal extension rods as opposed to torque being applied at the leading edge of where the brush head and handle join in prior-art brushes of FIGS. 1 and 2. This twin-fork type joining system may provide for reduced stress on the coupling point and thus allow for more torque to be applied to hair.

In addition, this embodiment allowed for functional separation of two distinct systems, namely the function of "attaching" and the function of "absorbing torque". This will make for increased robustness of each system.

Figure 14:
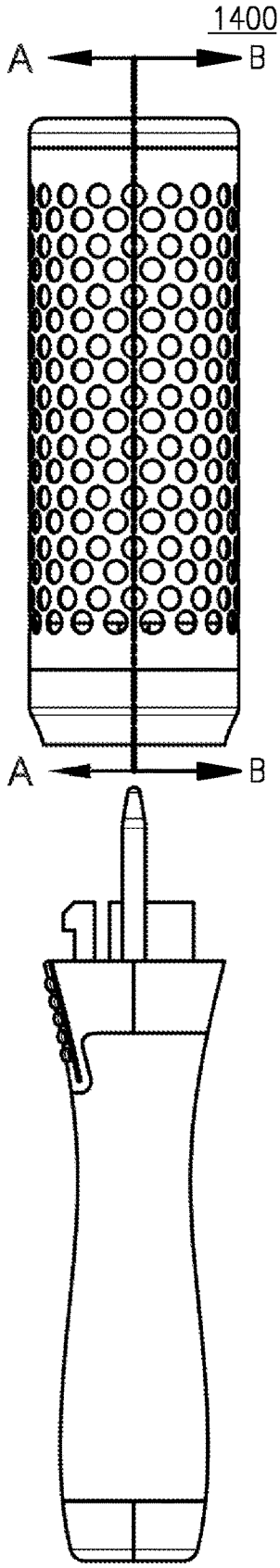
FIG. 14 illustrates a side view of the brush handle and brush head of FIG. 13.

FIG. 14 illustrates a side view of the brush handle and brush head of FIG. 13. As shown in FIG. 14, brush head and brush handle may be mated in a bi-directional fashion. In this way, a user of the brush system may orient the brush head in the 'A' direction or the 'B' direction. Bi-directional joining means there is no "up" or "down" and insertion of the brush head on brush handle works either way. Clear insertion of the forks may ensure good performance even if the spindle is not fully locked to the handle, unlike competing products that fail to perform at all unless and until the coupling and locking is made perfectly. The twin fork system therefore provides better on-the-fly usability ensuring product performance even when intended user instructions are only partially followed. As shown, a connection may be made with brush head oriented in the 'A' direction or oriented 180 degrees in the 'B' direction.

Figure 15:
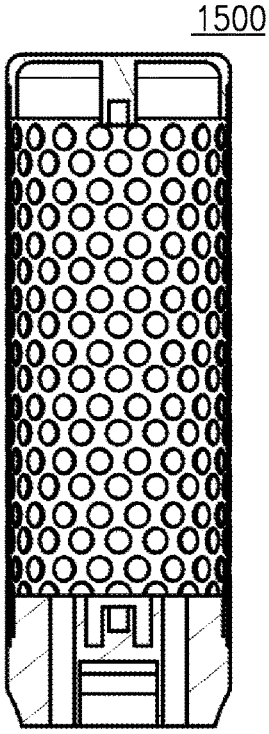
FIG. 15 illustrates a cross section of a brush head.

FIG. 15 illustrates a cross-sectional view 1500 of the mounting base that may be grafted or fitted to the end of commercially available brush rollers that provide for fitment with the brush handle. The lower portion of the figure shows the insertion points as prongs will be seated inside the brush roller base. Cross section 1500 further demonstrates the female end into which the male prongs insert at the base of the roller. In one embodiment, it may be preferable to source standard production brush heads and assemble the base of FIG. 15 onto an end of the brush heads in order to receive the pronged handle in contrast to recreating the wheel by custom fabrication of a roller assembly. The improvement of the design represented by the two-prong is beneficial for a variety of reasons including obviating the need to produce a customized roller head.

In an embodiment, bristle placement may be improved by relying on the mounting piece of FIG. 15 which is fitted at the end of a standard commercially available brush head. The new design therefore retains the benefits of driving torque along shafts, in this case, two prongs in lieu of a center single shaft, but does away with any problems related to bristle placement caused by the shaft infiltrating the center of the brush head. This represents an improvement in design that causes no diminishment in the performance of the brush head bristles. In essence, there is no interference with the main portion of the brush head.

Figure 16:
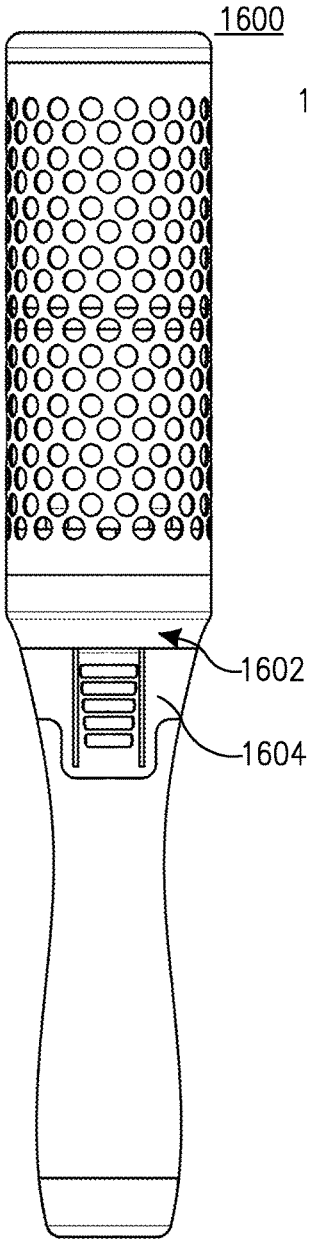
FIG. 16 illustrates a brush handle and brush head in a mated connection.
Figure 17:
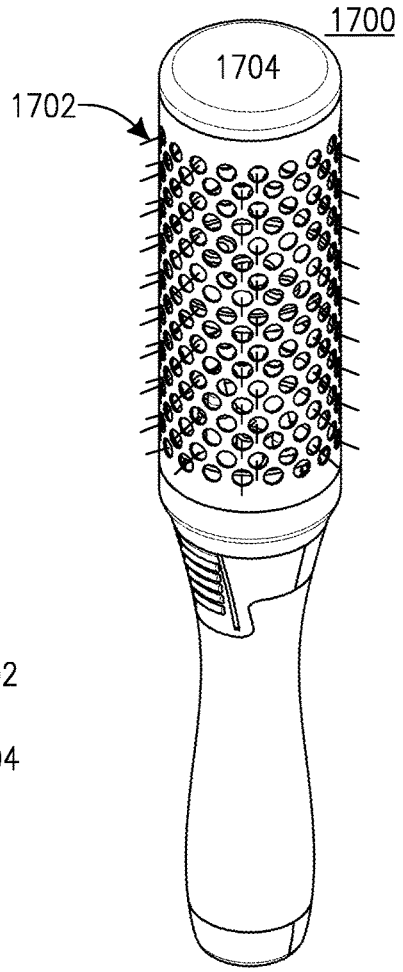
FIG. 17 illustrates another view of a brush handle and brush head in a mated connection.

FIG. 16 illustrates a side view of a brush handle and brush head in a mated or locked connection. When in a locked position, there is no (or a very minimal) gap between brush head 1602 and brush handle 1604. FIG. 17 illustrates another view of a brush handle and brush head tilted in a mated connection. In this FIG. bristles 1702 are shown extending from hair brush 1700 in a locked position. FIG. 17 also shows a top view of a plastic end cap 1704 of hair brush 1700.

Figure 18:
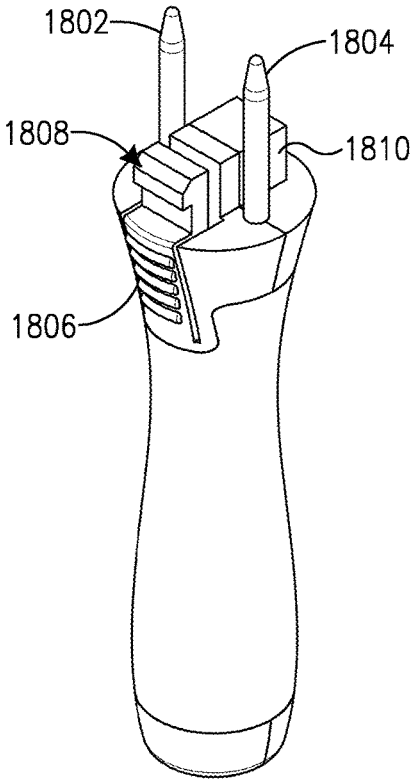
FIG. 18 illustrates a plurality of extension rods (twin forks), extended from a brush handle.

FIG. 18 illustrates the brush handle in the tilted view of FIG. 17. In FIG. 18, a plurality of extension rods, or twin forks 1802, 1804, extended from a brush handle 1800. As shown in FIG. 18, twin forks are tapered near the top end for easy attachment with a brush head. The button 1806 is configured to displace locking member 1808 from a locked position with a brush head. In this way, pressing the button 1806 by a user will cause a hair brush head to detach from hair brush handle 1800. A block 1810 may be incorporated adjacent button 1806 and locking mechanism 1808 to enable sound connection of a brush head to brush handle 1800. Locking mechanism 1808 may be tapered on one side to allow for mating attachment.

Figure 19:
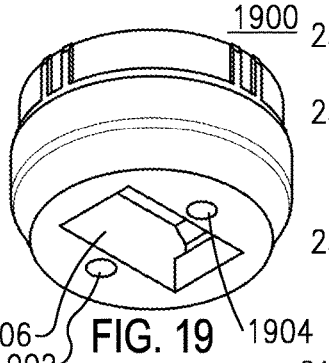
FIG. 19 illustrates an exemplary base of a brush head.

FIG. 19 illustrates an exemplary base of a brush head. Through holes 1902, 1904 are shown distal to the point of attachment 1906.

Figure 20:
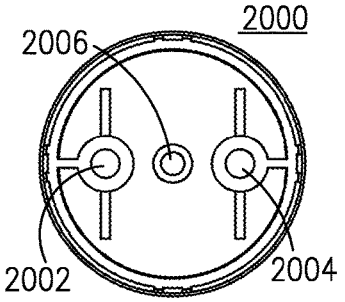
FIG. 20 is a bottom end view of the base of FIG. 19.
Figure 21:
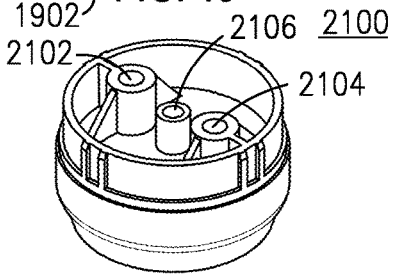
FIG. 21 is another illustration of the base of FIG. 19.

FIG. 20 is a top view 2000 of the base of FIG. 19. FIG. 20 shows a top view of channels 2002, 2004 for reception of metal extension rods. Circular portion 2006 may be used to mate the base 2000 onto commercially available brush heads. FIG. 21 is another illustration of the base of FIG. 19. Both of FIGS. 20 and 21 show an embodiment to which the benefits referenced above can be ascribed. This circular section 2106 shown at the very center of the base may be used for mounting the base 2000, 2100 to the base of a commercially available roller head, such that the brush head may accept the double-prongs. This circular device is the female end of the product. With it, commercially available brush heads may be modified by removing their native plastic end piece, replacing that end piece with end cap 2000, 2100, and thereby making the brush head adapted to accept the double prongs of the handle 1800. The circular section allows the embodiments of FIG. 13 to FIG. 23 to work with commercially available brush heads.

Figure 22:
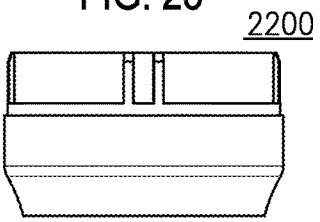
FIG. 22 is a side view of the base of FIG. 19.

FIG. 22 is a side view of the base of FIG. 19 and again shows an alternative view of channels 2102 and 2104 which may be formed via plastic, for example, polyethylene, polypropylene, polystyrene, polyvinyl chloride or other plastics commonly found in consumer products, toys or the like.

Figure 23:
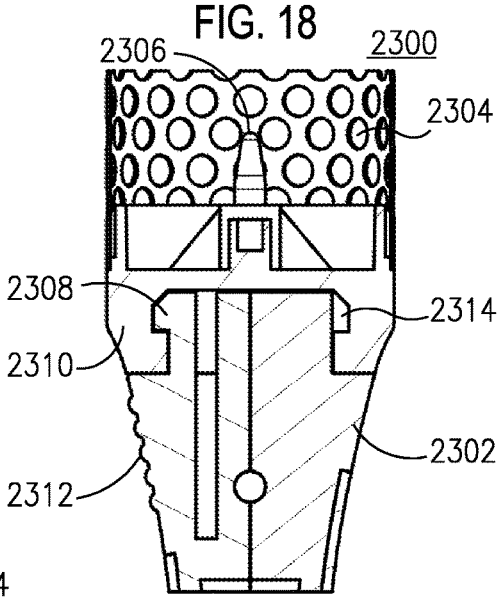
FIG. 23 illustrates a cross section of a brush handle, brush head and extending twin forks.

FIG. 23 illustrates a cross section 2300 of a brush handle 2302, brush head 2304 and one of the extending twin forks 2306. As shown in this cross section 2300, a locking connection is established via locking mechanism 2308 mating with base of brush head 2310. Locking mechanism 2308 may be tapered in such a way that locking of the brush handle 2302 with brush head 2304 may not require a button 2312 to be pressed at the time of engagement. This may not be true for brush head removal. Also shown in FIG. 23 is a gap 2304 formed between brush handle 2302 and brush head 2304. This gap 2304 is formed due to insertion orientation as there may only be one mating mechanism 2308 disposed upon the brush handle 2302.

Although features and elements are described above in particular combinations, each feature or element can be used alone or in any combination with or without the other features and elements. For example, each feature or element as described above may be used alone without the other features and elements or in various combinations with or without other features and elements. Sub-elements of the methods and features described above may be performed in any arbitrary order (including concurrently), in any combination or sub-combination.

Further embodiments herein may be formed by supplementing an embodiment with one or more elements from any one or more other embodiment herein and/or substituting one or more element from one embodiment with one or more element from one or more other embodiments herein.

It is understood, therefore, that this invention is not limited to the particular embodiments disclosed, but is intended to cover all modifications that are within the spirit and scope of the invention as defined by the appended claims; the above description; and/or shown in the attached drawings.

What is claimed is:

1. A hair brush apparatus comprising:

a handle comprising a button and a plurality of metal extension rods; and at least one brush head including a plurality of brush head channels for receiving the plurality of metal extension rods, wherein the plurality of metal extension rods extend through the plurality of brush head channels when the button is in a locked position, wherein the at least one brush head includes a base portion comprising a female mating element for coupling the base portion to an upper portion of the at least one brush head;

wherein the female mating element is located in between the plurality of channels.

2. The hair brush apparatus of claim 1, wherein the button is located on a side of the handle allowing for a thumb of a user of the hair brush apparatus to engage and release the at least one brush head into and from the locked position;

wherein the plurality of metal extension rods extend into the plurality of brush head channels when the at least one brush head is not in a locked position;

wherein the button is ribbed.

3. The hair brush apparatus of claim 1, wherein the at least one brush head and the handle are configured to mate in a plurality of orientations;

wherein the handle, the at least one brush head, the plurality of brush head channels and the plurality of metal extension rods have a same longitudinal axis;

wherein the female mating element is located at the center of the same longitudinal axis.

4. The hair brush apparatus of claim 1, wherein the plurality of metal extension rods are tapered, wherein the plurality of metal extension rods are of a same shape.

5. The hair brush apparatus of claim 1, wherein the plurality of metal extension rods are configured to absorb more torque than a locking mechanism of the hair brush apparatus.

6. The hair brush apparatus of claim 1, wherein the button does not displace the plurality of metal extension rods, wherein the plurality of metal extension rods are of a same size.

7. A hair brush apparatus comprising:

a handle comprising a plurality of tapered extension rods; and at least one brush head for receiving the plurality of tapered extension rods, wherein the plurality of tapered extension rods extend beyond a plurality of channels of the at least one brush head when the at least one brush head is in a locked position;

wherein the at least one brush head has a base portion comprising a mating element located in between the plurality of channels, wherein the mating element couples the base portion to an upper portion of the brush head.

8. The hair brush apparatus of claim 7, further comprising:

a plurality of buttons located on the handle, wherein the plurality of buttons are configured to release the at least one brush head from the locked position;

wherein the plurality of buttons engage a locking mechanism adjacent to the plurality of tapered extension rods.

9. The hair brush apparatus of claim 7, wherein the plurality of tapered extension rods are configured to absorb more torque than a locking mechanism of the hair brush apparatus, wherein the plurality of tapered extension rods are of a same shape.

10. The hair brush apparatus of claim 7, wherein the at least one brush head is formed by attachment of the base portion comprising the plurality of channels to an existing brush head.

11. The hair brush apparatus of claim 10, wherein the plurality of channels are configured for reception of the plurality of tapered extension rods, wherein the plurality of tapered extension rods are of a same size.

12. The hair brush apparatus of claim 7, wherein the handle, the at least one brush head, the plurality of channels and the plurality of tapered extension rods have a same longitudinal axis.

13. The hair brush apparatus of claim 7, wherein the plurality of tapered extension rods extend in parallel into the plurality of channels of the at least one brush head when the at least one brush head is not in a locked position.

14. The hair brush apparatus of claim 7, wherein the plurality of tapered extension rods are narrower than the plurality of channels and the plurality of tapered extension rods are of a same size and shape.

15. A hair brush apparatus comprising:

a handle comprising a plurality of tapered extension rods; and at least one brush head for receiving the plurality of tapered extension rods, wherein the plurality of tapered extension rods extend into a plurality of channels of the at least one brush head when the at least one brush head is in a locked position;

wherein the at least one brush head comprises a base portion, wherein the base portion is coupled to an upper portion of the brush head via a mating element located in between the plurality of channels.

16. The hair brush apparatus of claim 15, further comprising:

a plurality of buttons located on the handle, wherein the plurality of buttons are configured to release the at least one brush head from the locked position.

17. The hair brush apparatus of claim 15, wherein the plurality of tapered extension rods are configured to absorb more torque than a locking mechanism of the hair brush apparatus.

18. The hair brush apparatus of claim 15, wherein the at least one brush head is formed by attachment of the base portion comprising the plurality of channels to an existing brush head;

wherein the plurality of tapered extension rods are fixed to the handle.

19. The hair brush apparatus of claim 15, wherein the plurality of tapered extension rods are configured to extend into the plurality of channels of the at least one brush head when the at least one brush head is not in a locked position.

* * * * *